United States Patent [19]

Heaton

[11] 3,968,339

[45] July 6, 1976

[54] APERTURED DIAPHRAGM END VALVE

[76] Inventor: Joe Heaton, 120 W. Washington St., Tipton, Ind. 46072

[22] Filed: Nov. 25, 1974

[21] Appl. No.: 527,092

[52] U.S. Cl. ..... 200/86 A; 200/83 Q
[51] Int. Cl.[2] ..... H01H 13/16
[58] Field of Search ..... 200/86 A, 83 R, 83 Q, 200/83 B; 340/272, 31 R

[56] References Cited

UNITED STATES PATENTS

| | | | |
|---|---|---|---|
| 2,251,180 | 7/1941 | Wesley et al. | 200/86 A |
| 3,106,196 | 10/1963 | Woodward et al. | 200/83 R |
| 3,505,689 | 4/1970 | Neff et al. | 200/83 Q |

*Primary Examiner*—David Smith, Jr.
*Attorney, Agent, or Firm*—David H. Semmes

[57] ABSTRACT

A valve which produces an electrical signal upon pressure changes in which a diaphragm having an aperture contacts a leaf spring having a projection thereon. The valve provides for both controlled leakage of air, and intake of air in semi-closed static air signal system, particularly useful in vehicle driving instruction and scoring devices.

7 Claims, 4 Drawing Figures

APERTURED DIAPHRAGM END VALVE

BACKGROUND OF THE INVENTION

In U.S. application Ser. No. 411,112, filed Oct. 30, 1973, a device is presented which aids in automobile parking instruction which consists of two portable and resiliently suspended curb elements employed in combination with a plurality of pressure sensitive elements supported on the parking surface in front of the curbs, so as to signal the distance away from the curbs of the parked student vehicle tires with respect to the curbs.

A pair of portable base elements are provided for resilient suspension of corresponding curb elements above the parking surface. The curb elements may be, for example, 10 to 20 feet in length and aligned with respect to each other, so as to define a conventional or otherwise adjustable parking surface. Pneumatic signaling means in a continuous circuit are laid out upon the parking surface in front of the curb elements and between the base elements and the curb elements. As a result, the student driver in attempted parking depresses that part of the pneumatic signaling means laid out upon the parking surface in front of the curb elements. The depression of the vehicle tires upon the pneumatic signaling means activates the signaling and scoring means resulting in a scoring of the parking effort and visual or audible signaling of the distance away from the curbs of the front and rear tires of the parked student vehicle.

A pressure sensitive signaling means may include pneumatic lines or alternatively other pressure sensitive means which may be monitored electrically. The pneumatic lines, incorporating the apertured diaphragm end valve can be constructed in a continuous circuit, such that the air pressure inside the semiclosed system can adjust to the pressure outside the system when the system is not in use and such that the air pressure does not leak from the circuit upon depression by the vehicle tires when the system is in use and such that upon release of the weight of the vehicle tires the system is permitted to take in outside air so as to equalize the inside pressure with the air pressure outside the system, thus readying the system for the next user.

DESCRIPTION OF THE PREFERRED EMBODIMENTS

Figure 1:
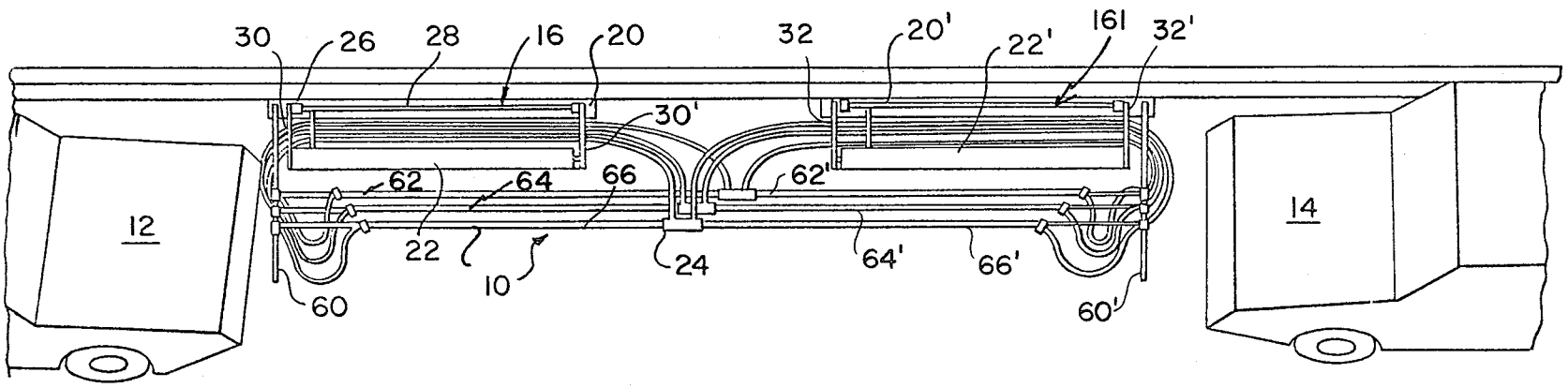
FIG. 1 is a top plan of a parking device employing the apertured diaphragm end valve of the present invention further showing a pair of curb elements and pneumatic signaling means aligned intermediate to simulated vehicles.

In FIG. 1 a parking training system 10 is shown as layed out between simulated vehicle rear 12 and simulated vehicle front 14. The parking system is to include a pair of identical base elements 16 and 16$^1$ and corresponding curb shaped elements 22 and 22$^1$ suspended resiliently from the base elements.

The individual curb-like devices 16 include base element 20 supporting signaling wiring conduit 28, junction box 26 and at each end, a pair of leaf type springs 30, 30$^1$ secured at one end to base 20.

Figure 2:
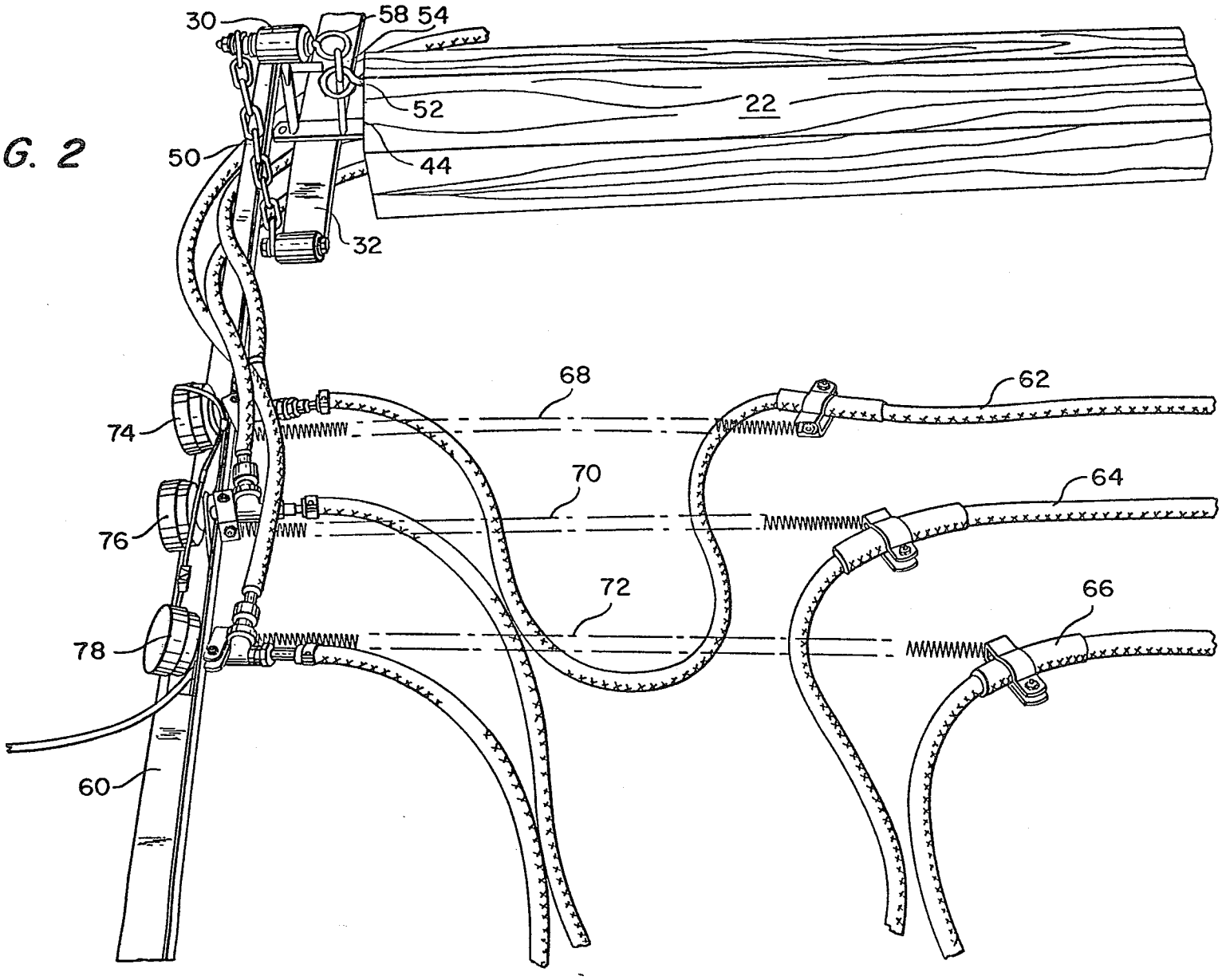
FIG. 2 is an enlarged fragmentary top plan, showing resilient suspension of the pneumatic lines parallel to the curb.

The pressure sensitive signaling means includes pneumatic lines or alternatively other pressure sensitive means which may be monitored electrically. A pair of transverse beams 60, 60$^1$ extend laterally from the base so as to support the suggested pneumatic lines 62, 64, 66, their respective tension springs 68, 70 and 72 and signaling switches 74, 76 and 78 (FIG. 2).

As illustrated in FIG. 1, the pneumatic lines 62, 64 and 66 are each constructed in a continuous circuit and are related with curb element 22. Pneumatic lines 62$^1$, 64$^1$, and 66$^1$ are each constructed in a continuous circuit and are related with curb element 22$^1$. Pneumatic lines 62 and 62$^1$, 64 and 64$^1$, 66 and 66$^1$ are joined at the center in the area of 24 to provide continuous "line" so that constant spring tension from springs or other elastic material 68, 70, 72 and their counter parts 68$^1$, 70$^1$, 72$^1$ (not shown) permit the pneumatic lines to flex as student vehicle wheels roll upon and/or turn in direction upon the pneumatic lines as the student maneuvers the automobile and also permits the pneumatic lines to self adjust to a position parallel to the curb elements upon release of student automobile tire forces. Air does not circulate between pneumatic lines 62 and 62$^1$ or 64 and 64$^1$ or 66 and 66$^1$.

Pneumatic lines 62, 64 and 66 are connected to apertured diaphragm end valves 74, 76 and 78 score the tire distance away from curb element 22 and pneumatic lines 62$^1$, 64$^1$ and 66$^1$ connected to apertured diaphragm end valves 74$^1$, 76$^1$ and 78$^1$ (not shown) score the tire distance away from curb element 22$^1$. Both front and rear wheels are scored upon completion of the student attempt to park the student automobile. (The wheel distance from curb scoring system is not used during the time the student is attempting to enter or exit the parking space. The system is used only after the vehicle is parked). Student automobile wheel violation of curb elements 22 and 22$^1$ are scored by separate switch elements which are components of the curb.

Figure 3:
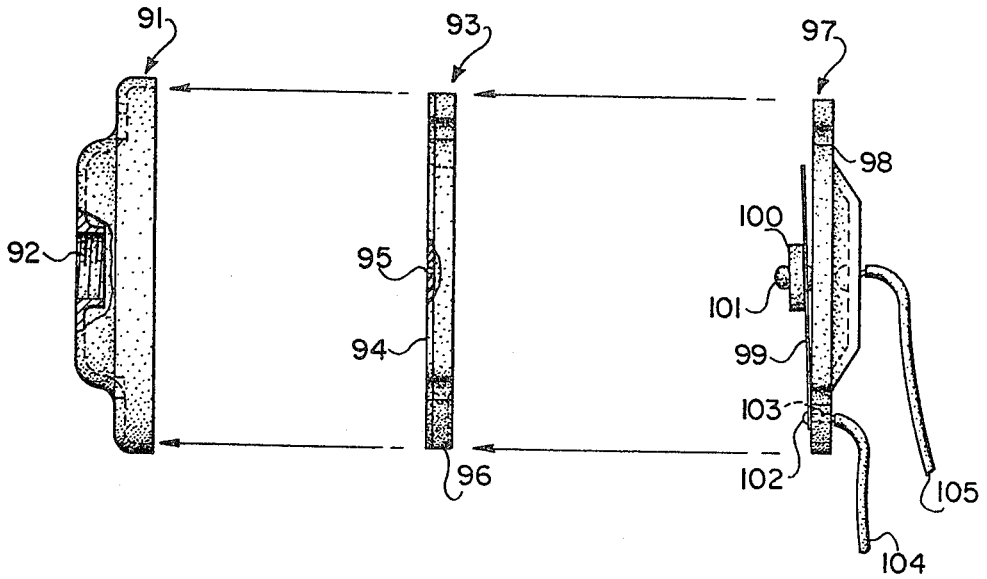
FIG. 3 is a side exploded view of the apertured diaphragm end valve of the present invention.
Figure 4:
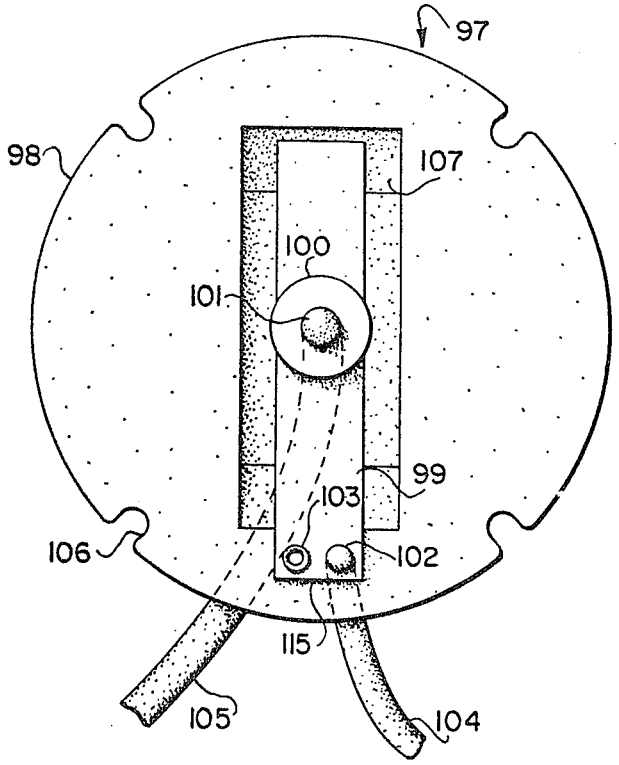
FIG. 4 is a front planned view of the backing plate of the apertured diaphragm end valve.

As illustrated in FIGS. 3 and 4, the diaphragm end valve of the present invention comprises end plate 91 conveniently constructed of any rigid, impact resistant material such as metal, plastic, etc. Orifice 92 is fabricated in cap 91 for containing lines 62, 64 and 66 (FIG. 2). Orifice 92 can be threaded in order to improve air tight engagement between the pressure lines and the interior of the cap 91.

Diaphragm 93 consists of rigid support 96 which can be hard impact plastic having indentions 106 for engaging screw members (not shown) securing diaphragm element 93 into cap 91. Resilient blatter 94 can be constructed of any acceptable material. The exact formulation and thickness of diaphragm 94 depends upon the pressure characteristics of the system. Naturally, a system which encounters extremely high pressure changes would require a relatively thick diaphragm. At the center of diaphragm 94 is aperture 95 the size of which depends upon the amount of "bleeding" deemed desirable. Again, the size of the aperture would be a choice depending upon the nature of the system. For example, if extremely large pressure changes are anticipated through, for example, large temperature changes in the environment, a relatively large aperture would be employed.

End plate 97 is comprised of disc 98 which can be composed of hard impact plastic, metal, etc. and is indented at 106 for receiving screws (not shown) for sealably engaging end plate 97 into front plate 91. Disc 98 is further indented at 107 to allow for resilient movement of leaf spring 99. Leaf spring 99 is attached to disc 98 at 115. Proximate edge 115 is located electrical contact connection 102 to wire 104 and bleed exit port 103 which allows for the bleeding of air which has passed through aperture 95. Contained on leaf spring 99 placed to coincide with the geometric center of diaphragm 94 is contact washer 100 and projection 101.

In practice, normal expansion and contraction of air and rubber hosing from cold early mornings to high noon sun requires a "closed" system which can "breathe". These pressure changes occur gradually which allows air to pass through orifice 92, aperture 95 and bleed port 103. When abrupt, massive pressure changes are encountered through pressure being exerted upon hoses 62, 64, and 66, diaphragm 94 distorts and engages raised area 101. This completely closes the aperture 95 and a completely closed system is encountered. As the diaphragm distorts in response to pressure changes, diaphragm 94 presses against the rear of disc 98 contacting wire 105 and thus completing the circuit between 104 and wire 105.

Apertured diaphragm end valves 74, 76, 78 are placed within the closed system by means of T-joints 200, 201, 202. Thus, air within the closed system can recirculate on either side of the T-joint which permits the driver of the car to go forward or backward longitudinally along the tube and pressure is maintained upon the apertured diaphragm end valve. If this recirculation concept were not employed, contact would only be achieved as the driver went toward the apertured diaphragm end valve and the aperture would pull away from the leaf spring as the drive backed up away from the valve. Furthermore, the recirculation concept greatly minimizes the possibility of rupturing the hose connections as a vehicle approaches the valve. Without equalization fore and aft the tire, as a tire approaches the apertured diaphragm end valve, great pressures would be built to a point which would cause serious injury to the system.

Although the apertured diaphragm end valve of the present invention has been described with respect to the vehicle parking instruction and scoring curb device of U.S. application Ser. No. 411,112, such a valve can be used in any system which requires the bleeding of air through the valve during non-stress situations, while air tight contact is required during high stress situations in which pressure changes are large enough to distort the diaphragm. Manifestly, the apertured diaphragm end valve may be variously configured without departing from the spirit of the invention.

I claim:

1. An apertured diaphragm end valve capable of providing controlled pressure leakage in a pneumatic system comprising:

A. an end plate containing a central aperture for connection to a pneumatic hose;

B. a diaphragm element for engagement with said end plate comprising;

i. a rigid support ring; and ii. a resilient blatter defined by said support ring and having a centrally located aperture therein;

C. a backing second end plate containing:

i. an aperture bleed port;

ii. metal contacts for closing an electric circuit upon deflection of said diaphragm;

iii. a metallic leaf spring which touches said metal contacts upon the closing of said electric circuit and contained thereon, a projection aligned with said aperture of said blatter.

2. The apertured diaphragm end valve of claim 1 wherein said diaphragm and second backing end plate are so spaced as to allow for controlled air leakage through said apertures contained in said blatter and second backing end plate when said electric circuit is not closed.

3. The apertured diaphragm end valve of claim 1 wherein said central aperture is in threaded engagement with said pneumatic system.

4. The apertured diaphragm end valve of claim 1 wherein said end plate is metal.

5. In a vehicle parking instruction device comprising:

A. a base including means extending laterally thereof as a support for a simulated curb;

B. a simulated curb resiliently suspended apart from said base and above a parking surface;

C. at least one pressure sensitive element supported upon said parking surface adjacent said curb; and D. signal means connected to said pressure sensitive element as an indicator of the student vehicle tire position with respect to said curb;

the improvement comprising:

said pressure sensitive element being an apertured diaphragm end valve capable of providing controlled pressure leakage in the vehicle instruction device, said apertured diaphragm end valve comprising:

A. an end plate containing a central aperture for connection to a pneumatic hose;

B. a diaphragm element for engagement with said end plate comprising:

i. a rigid support ring; and ii. a resilient blatter defined by said support ring and having a centrally located aperture therein;

C. a backing second end plate containing i. an aperture bleed port;

ii. metal contacts for activating said signal means upon deflection of said diaphragm;

iii. a metallic leaf spring which touches said metal contacts upon activation of said signal means and contained thereon a projection aligned with said aperture of said blatter.

6. The vehicle parking instruction device of claim 5 wherein said diaphragm and second backing end plate are so spaced as to allow for controlled air leakage through said apertures contained in said blatter and second backing end plate when said signal means is not activated.

7. An apertured diaphragm end valve capable of providing controlled pressure leakage in a pneumatic system comprising;

A. an end plate containing an aperture for connection to a pneumatic hose;

B. a diaphragm engaging said end plate and having an aperture therein and

C. a backing plate having an aperture bleed port and including a contact for closing an electric circuit upon deflection of said diaphragm said contacts including a projection aligned with said diaphragm aperture.

* * * * *